US009913531B1

(12) United States Patent
Wang

(10) Patent No.: US 9,913,531 B1
(45) Date of Patent: Mar. 13, 2018

(54) FOLD-IN-HALF TABLE HAVING A SERPENTINE CENTRAL SUPPORT TUBE

(71) Applicant: Zhuhai Shichang Metals Ltd., Zhuhai (CN)

(72) Inventor: Che-Jen Wang, Zhuhai (CN)

(73) Assignee: Zhuhai Schichang Metals Ltd., Zhuhai (CN)

( * ) Notice: Subject to any disclaimer, the term of this patent is extended or adjusted under 35 U.S.C. 154(b) by 25 days.

(21) Appl. No.: 15/448,674

(22) Filed: Mar. 3, 2017

(51) Int. Cl.

| | |
|---|---|
| ***A47B 3/083*** | (2006.01) |
| ***A47B 3/087*** | (2006.01) |
| ***A47B 13/08*** | (2006.01) |
| ***A47B 3/091*** | (2006.01) |

(52) U.S. Cl.
CPC ..... *A47B 3/087* (2013.01); *A47B 3/0912* (2013.01); *A47B 13/088* (2013.01)

(58) Field of Classification Search
CPC ..... A47B 3/087; A47B 3/0912; A47B 13/088
USPC ..... 108/169, 129–133
See application file for complete search history.

(56) References Cited

U.S. PATENT DOCUMENTS

| | | | | |
|---|---|---|---|---|
| 1,446,924 | A * | 2/1923 | Nicholson | A47B 3/0912 211/182 |
| 3,304,891 | A * | 2/1967 | Rachman | A47B 3/083 108/36 |
| 7,096,799 | B2 | 8/2006 | Strong et al. | |
| 7,278,515 | B2 * | 10/2007 | Moser | E04G 1/28 108/169 |
| 7,621,224 | B2 * | 11/2009 | Lin | A47B 3/087 108/115 |
| 7,707,948 | B2 | 5/2010 | Lin | |
| 7,752,982 | B2 | 7/2010 | Lin | |
| 8,397,653 | B2 * | 3/2013 | Ashby | A47B 3/0818 108/115 |
| 9,277,808 | B2 * | 3/2016 | Cai | |
| 9,380,862 | B1 | 7/2016 | Lin | |
| 9,526,327 | B1 * | 12/2016 | Lin | A47B 3/087 |
| 2006/0236905 | A1 * | 10/2006 | Neunzert | A47B 3/0915 108/169 |
| 2007/0056485 | A1 * | 3/2007 | Tsai | A47B 3/087 108/169 |

* cited by examiner

*Primary Examiner* — Daniel J Troy
*Assistant Examiner* — Timothy M Ayres
(74) *Attorney, Agent, or Firm* — Luedeka Neely Group PC

(57) ABSTRACT

A collapsible table has first and second tabletop portions. A pair of first side rails is attached to the first tabletop portion, and a pair of second side rails is attached to the second tabletop portion. First and second leg assemblies are pivotally connected between the first and second side rails. A pair of hinges rotatably connect the first side rails to the second side rails along a hinge axis. A serpentine central support tube includes one or more first tubular portions disposed to one side of the hinge axis toward the first tabletop portion, and one or more second tubular portions disposed to an opposing side of the hinge axis toward the second tabletop portion. The one or more first tubular portions support the first tabletop portion at its inner edge, and the one or more second tubular portions support the second tabletop portion at its inner edge.

15 Claims, 7 Drawing Sheets

FOLD-IN-HALF TABLE HAVING A SERPENTINE CENTRAL SUPPORT TUBE

FIELD

This invention relates to the field of furniture. More particularly, this invention relates to a table having a fold-in-half tabletop, collapsible legs, and a serpentine central support tube for supporting a central region of the tabletop.

BACKGROUND

Banquet and utility tables having collapsible legs and fold-in-half tabletops are well known. Conventionally, fold-in-half tabletops comprise two plastic tabletop halves that are formed by blow molding or injection molding. When the table is unfolded into the use position in which the tabletop halves are aligned, the inner edges of the tabletop halves come together in the center of the tabletop. In some designs, such as described in U.S. Pat. No. 7,096,799 and depicted in FIG. 11, the inner edges of the tabletop halves have interlocking and overlapping features that are integrally formed as parts of the molded tabletop halves. When the tabletop halves are aligned in the use position, the interlocking features 234 and overlapping features 236 of the two halves will be interconnected, thereby forming a more rigid tabletop.

Though a rigid tabletop is desirable, providing integral interlocking and overlapping features in the tabletop halves introduces further complexity and cost to the mold in which the tabletop halves are formed. Further, because these features are located at or near the mold separation line where two mold halves come together, the removal of any plastic burs in the molded parts at the mold separation line is made more difficult. It is easier to remove burs if the mold separation line coincides with a straight edge surface, with no features projecting from the edge surface. Thus, elimination of the interlocking features would make the manufacturing process more efficient.

What is needed, therefore, is a fold-in-half tabletop that is sufficiently rigid and has straight surfaces along the inner edges of the tabletop halves, with no molded interlocking features.

SUMMARY

The above and other needs are met by a collapsible table having a use position and a storage position. The collapsible table includes a tabletop comprising a first tabletop portion having a first inner edge, and a second tabletop portion having a second inner edge. The first and second inner edges are adjacent each other when the table is in the use position, and the first and second inner edges are separated from each other when the table is in the storage position. The collapsible table also includes a pair of opposing first side rails attached to the first tabletop portion, and a pair of opposing second side rails attached to the second tabletop portion. A first leg assembly is pivotally connected between the first side rails, and a second leg assembly is pivotally connected between the second side rails. The first leg assembly extends downward from the first tabletop portion when the table is in the use position, and the first leg assembly is disposed adjacent the first tabletop portion when the table is in the storage position. The second leg assembly extends downward from the second tabletop portion when the table is in the use position, and the second leg assembly is disposed adjacent the second tabletop portion when the table is in the storage position. A pair of hinges is disposed on a hinge axis. Each of the hinges connects one of the first side rails to one of the second side rails, such that the first and second tabletop portions are operable to pivot with respect to each other about the hinge axis.

The collapsible table also includes a serpentine central support tube disposed along the hinge axis. The central support tube comprises one or more first tubular portions disposed to one side of the hinge axis toward the first tabletop portion, and one or more second tubular portions disposed to an opposing side of the hinge axis toward the second tabletop portion. When the table is in the use position, the one or more first tubular portions provide support for the first tabletop portion at the first inner edge, and one or more second tubular portions provide support for the second tabletop portion at the second inner edge.

In some embodiments, the central support tube includes one second tubular portion disposed adjacent a central region of the first inner edge, and two first tubular portions, wherein one of the two first tubular portions is disposed to either side of the second tubular portion. The two first tubular portions of this embodiment are curved toward the first tabletop portion, and the second tubular portion is parallel to the first inner edge of the first tabletop portion.

In some embodiments, the first tubular portions of the central support tube each include an aperture through which a fastener passes to attach the central support tube to the first tabletop portion.

In some embodiments, the first and second tabletop portions are formed from blow-molded plastic.

In some embodiments, the first and second inner edges of the first and second tabletop portions are straight and parallel to the hinge axis.

In some embodiments, the first leg assembly is pivotally connected to the first side rails and the second leg assembly is pivotally connected to the second side rails.

In some embodiments, the collapsible table includes a pair of first articulating brace assemblies connected between the first leg assembly and the first side rails, and a pair of second articulating brace assemblies connected between the second leg assembly and the second side rails.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
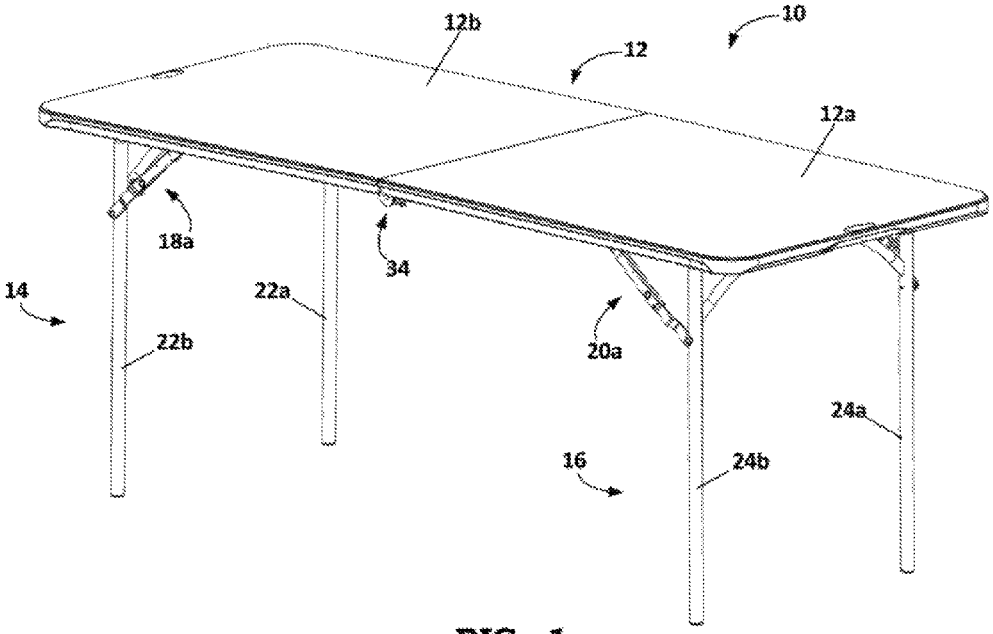
FIG. 1 depicts a top perspective view of a fold-in-half collapsible table in a use position according to a preferred embodiment.
Figure 2:
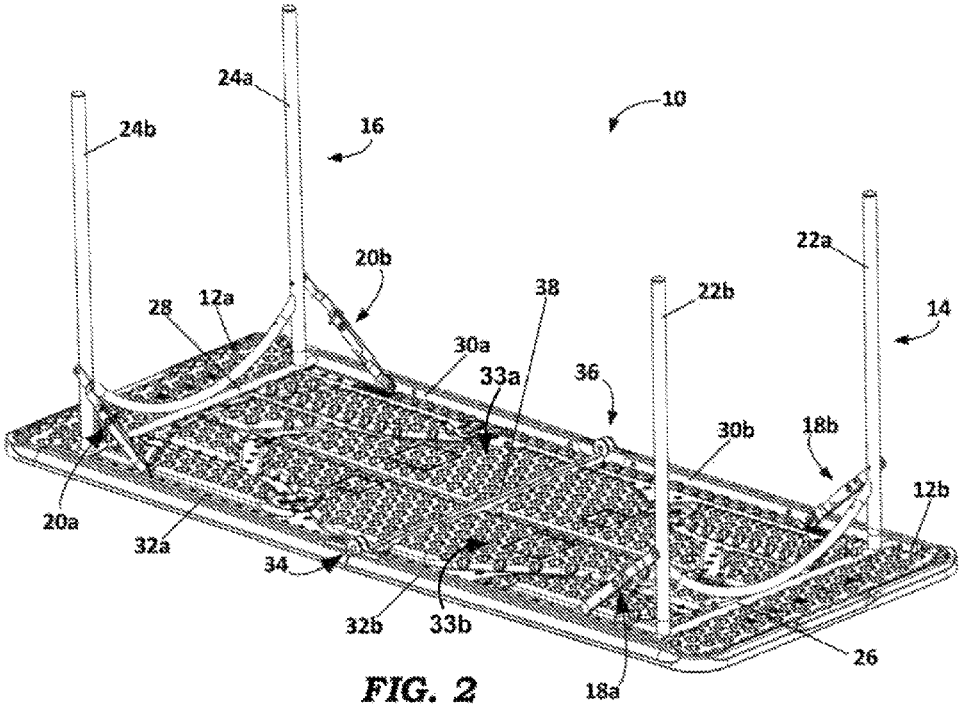
FIG. 2 depicts a bottom perspective view of the fold-in-half collapsible table in the use position according to a preferred embodiment.
Figure 3:
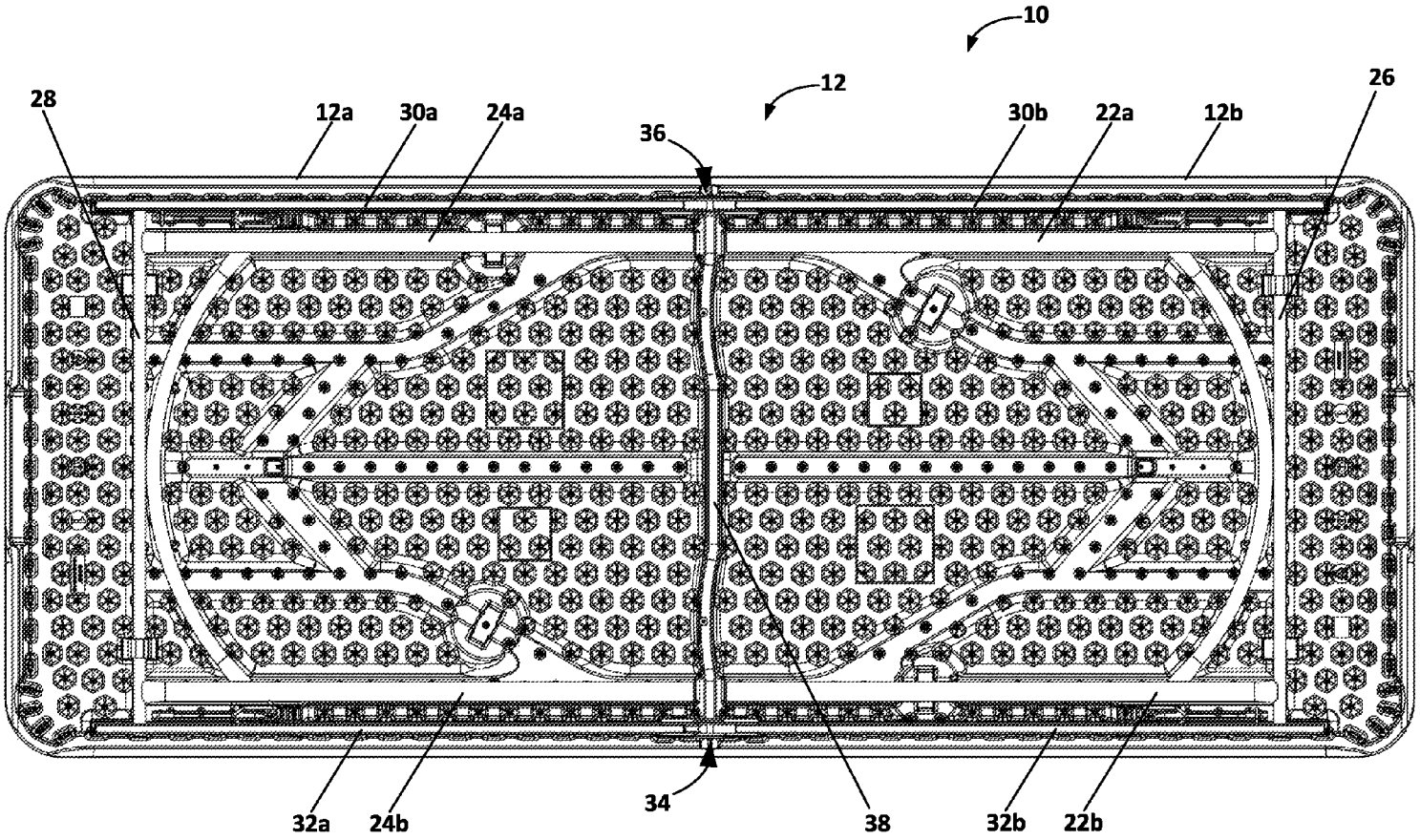
FIG. 3 depicts a bottom plan view of the fold-in-half collapsible table with its legs collapsed according to a preferred embodiment.

As depicted in FIGS. 1-10, a fold-in-half table 10 has a tabletop 12 comprising first and second tabletop portions 12*a* and 12*b*. In the use position depicted in FIG. 1, the tabletop 12 is supported by first and second leg assemblies 14 and 16 that extend downward from the tabletop 12. The first leg assembly 14 includes a first cross member 28 that is pivotally attached at one end to a first side rail 30*a* and at the other end to an opposing first side rail 32*a*. The second leg assembly 16 includes a second cross member 26 that is pivotally attached at one end to a second side rail 30*b* and at the other end to an opposing second side rail 32*b*. Articulated brace assemblies 20*a* and 20*b* maintain the first leg assembly in the use position relative to the first side rails 30*a* and 32*a*. Articulated brace assemblies 18*a* and 18*b* maintain the second leg assembly in the use position relative to the second side rails 30*b* and 32*b*.

Figure 4:
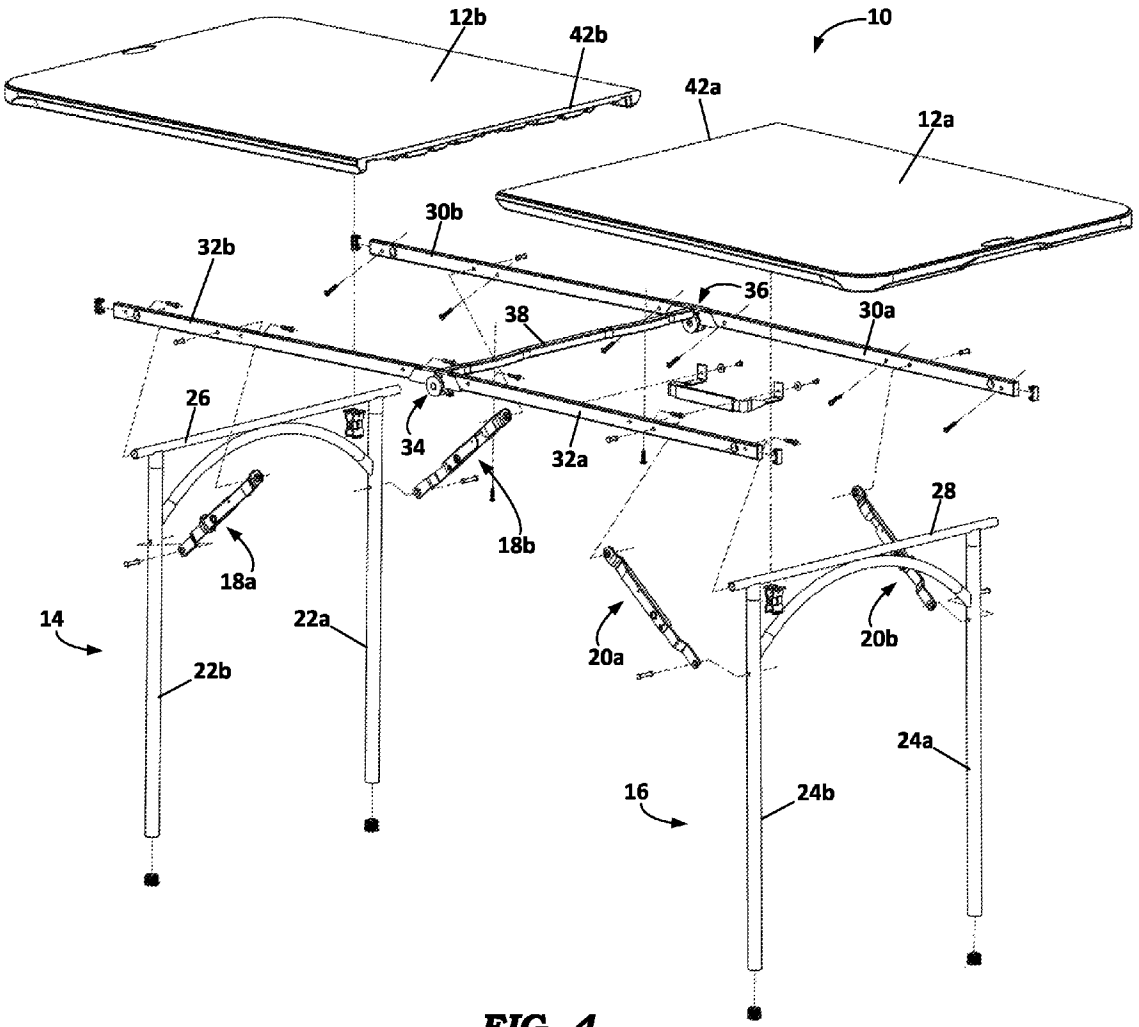
FIG. 4 depicts an exploded top perspective view of the fold-in-half collapsible table according to a preferred embodiment.
Figure 5:
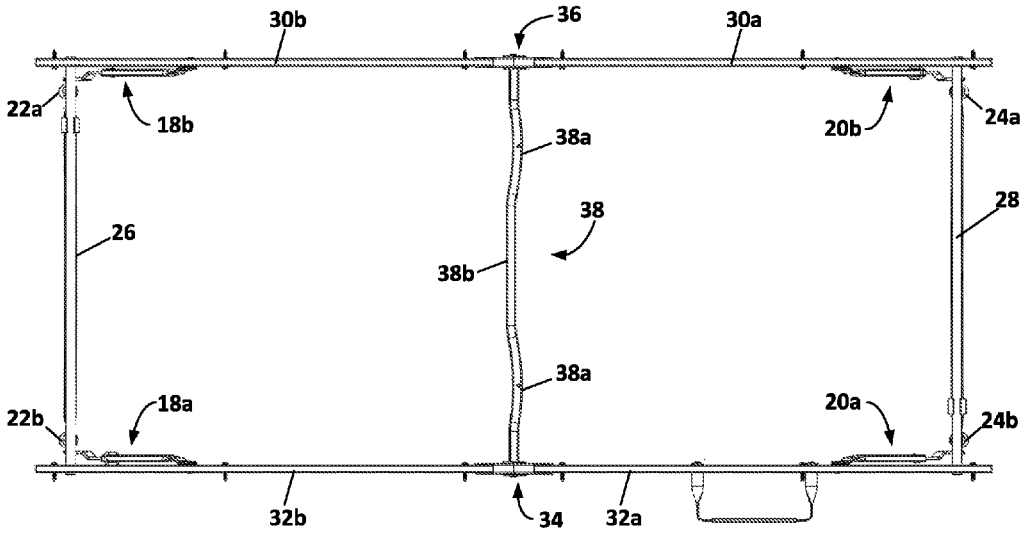
FIG. 5 depicts a top plan view of a frame of the fold-in-half collapsible table according to a preferred embodiment.
Figure 6:
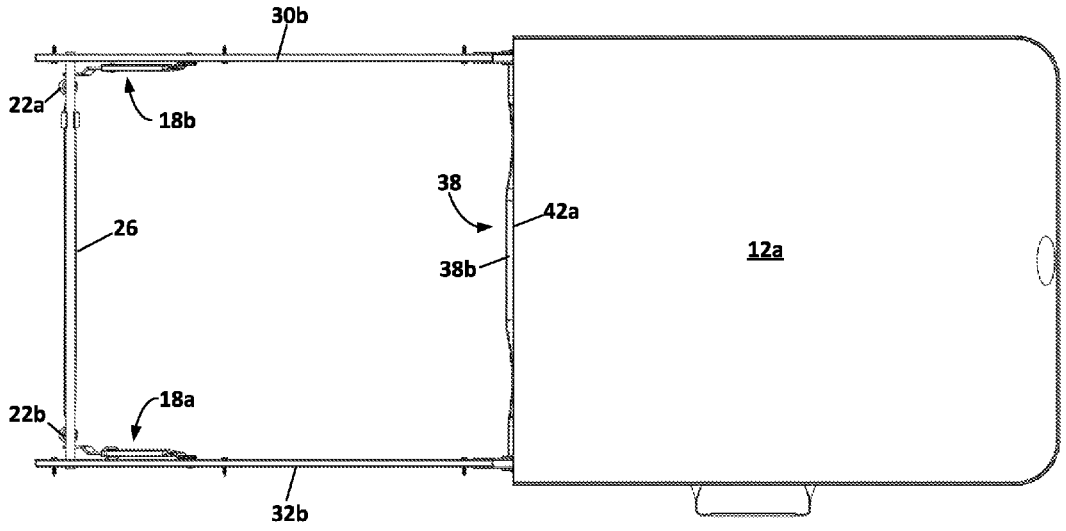
FIG. 6 depicts a top plan view of the frame of the fold-in-half collapsible table with one tabletop portion in place according to a preferred embodiment.
Figure 9:
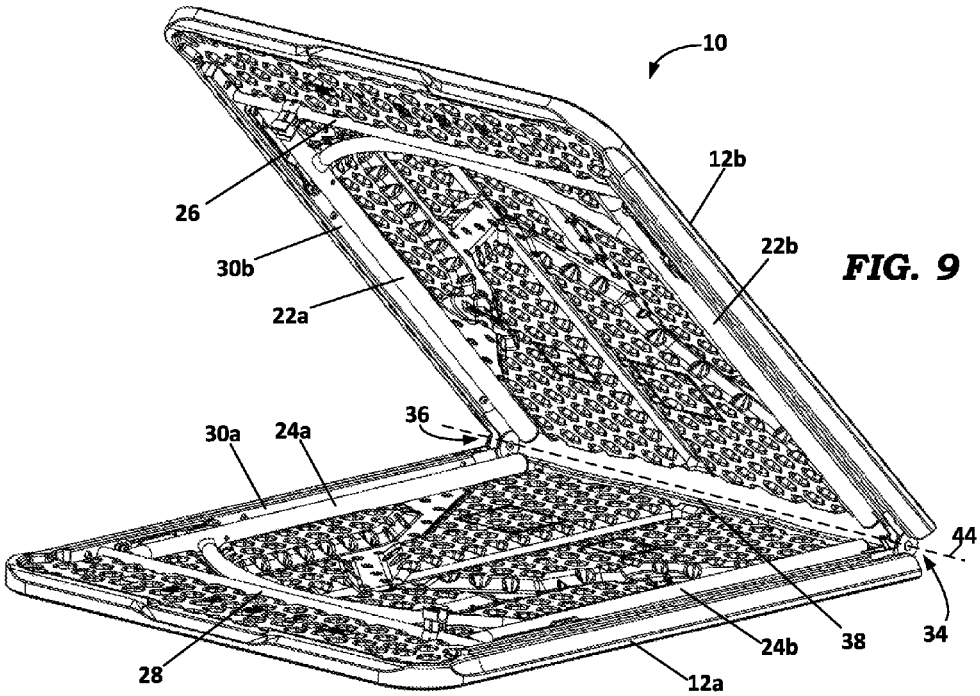
FIGS. 9 and 10 depict the fold-in-half collapsible table in a partially folded position according to a preferred embodiment.
Figure 10:
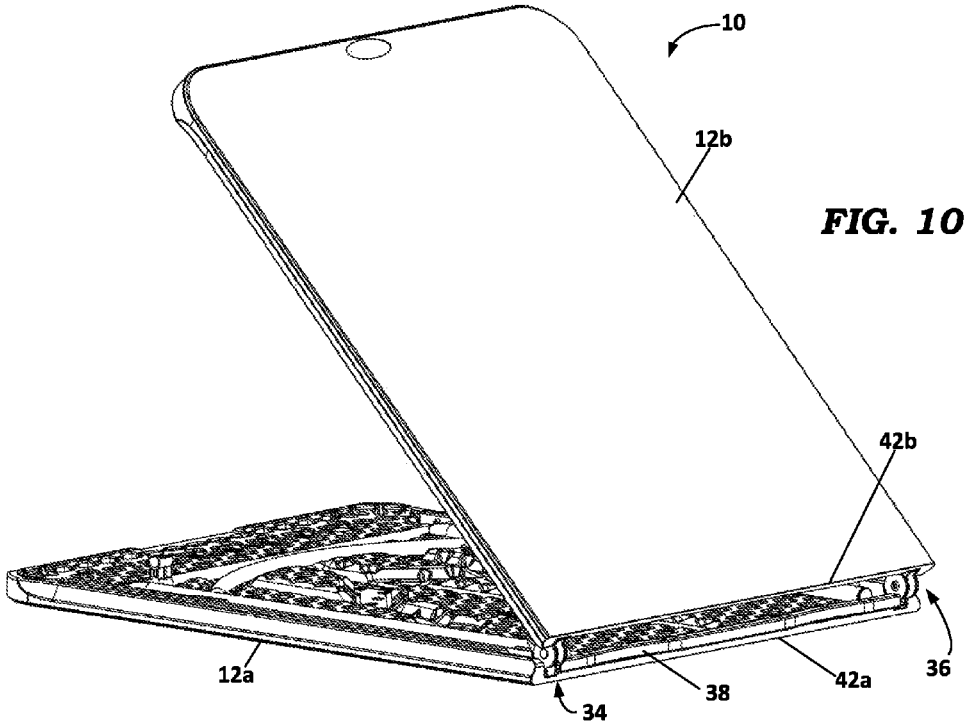
Figure 11:
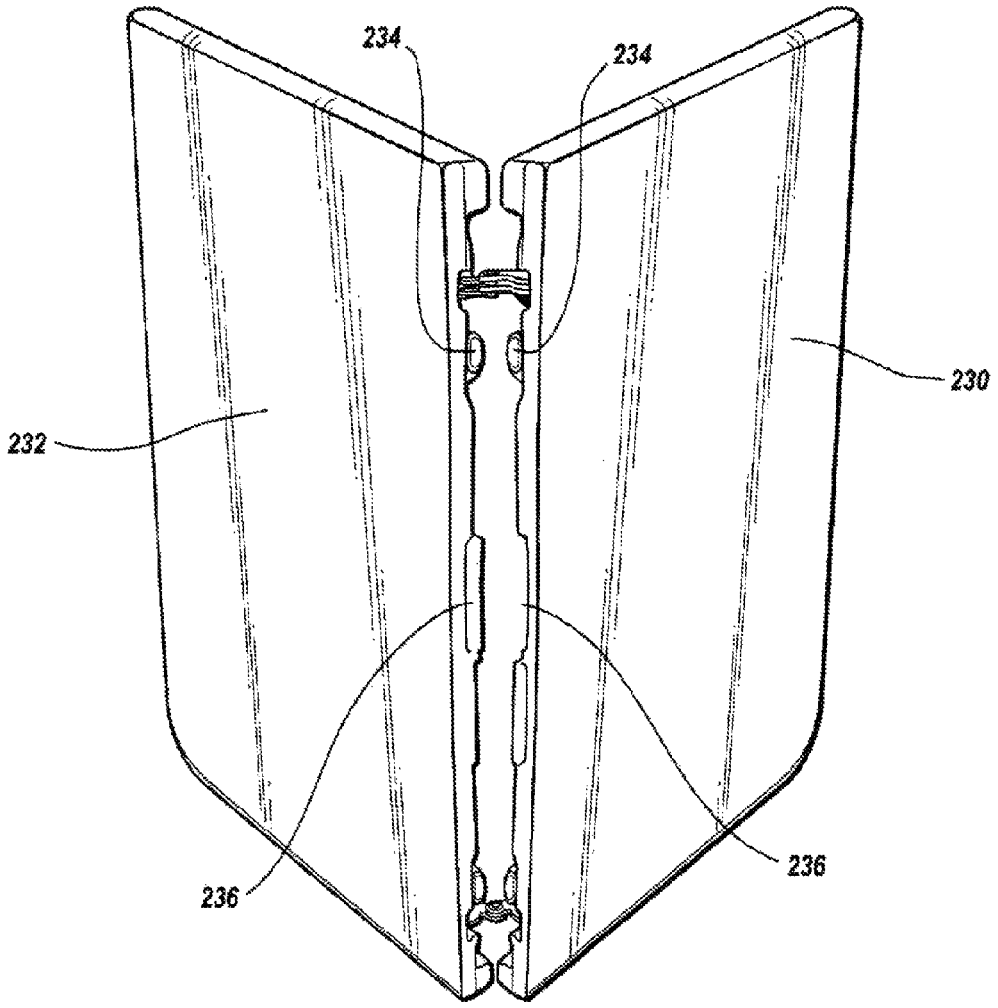
FIG. 11 (Prior Art)
FIG. 11 depicts a prior art fold-in-half table.

The first side rails 30*a*-32*a* are preferably attached to a first bottom surface 33*a* of the first tabletop portion 12*a* and the second side rails 30*b*-32*b* are preferably attached to a second bottom surface 33*b* of the second tabletop portion 12*b*, respectively, using screws or other fasteners as depicted in FIG. 4. The first side rail 30*a* is pivotally connected to the second side rail 30*b* by a hinge assembly 36. Similarly, the first side rail 32*a* is pivotally connected to the second side rail 32*b* by a hinge assembly 34. When the leg assemblies 14 and 16 are collapsed into the storage position as shown in FIGS. 9 and 10, the hinge assemblies 34 and 36 allow the tabletop portion 12*a* to pivot relative to the tabletop portion 12*b* along a hinge axis 44.

Figure 7:
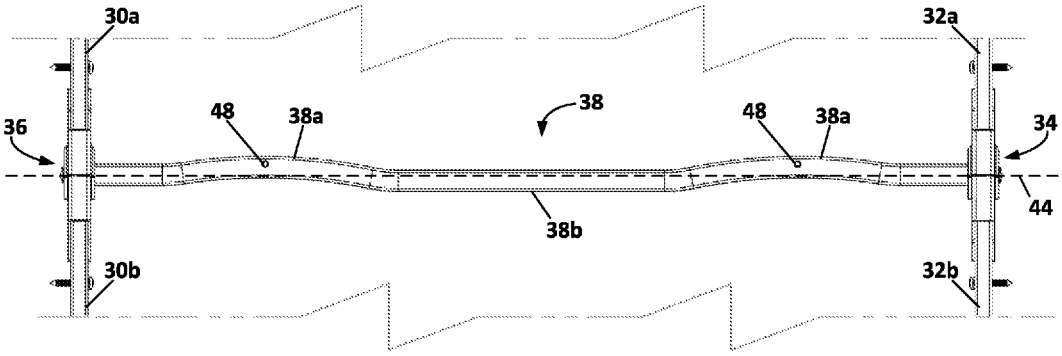
FIG. 7 depicts a top plan view of a central support tube of the fold-in-half collapsible table according to a preferred embodiment.
Figure 8:
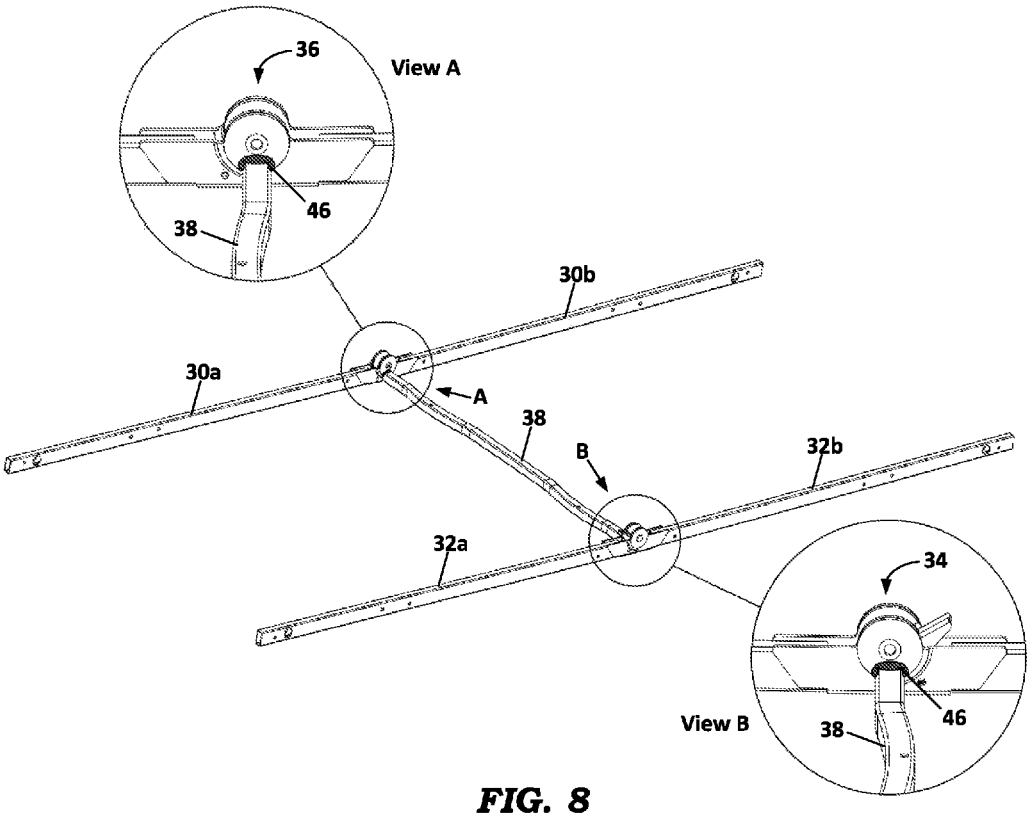
FIG. 8 depicts a top perspective view of the frame of the fold-in-half collapsible table according to a preferred embodiment.

As depicted in FIG. 7, a serpentine central support tube 38 extends between the hinge assemblies 34 and 36 along the hinge axis 44. In one embodiment depicted in FIG. 8, the ends of the central support tube 38 are attached to the hinge assemblies 34 and 36 by weld joints 46. The central support tube 38 includes one or more first tubular portions 38*a* disposed to one side of the hinge axis 44 toward the first tabletop portion 12*a*, and one or more second tubular portions 38*b* disposed to an opposing side of the hinge axis 44 toward the second tabletop portion 12*b*. When the table 10 is in the use position, the one or more first tubular portions 38*a* extend under and provide support for the first tabletop portion 12*a* along its inner edge 42*a*, and one or more second tubular portions 38*b* extend under and provide support for the second tabletop portion 12*b* along its inner edge 42*b*. In a preferred embodiment depicted in the figures, the central support tube 38 comprises two first tubular portions 38*a* and one second tubular portion 38*b*. The second tubular portion 38*b* is disposed near a central region of the inner edge 42*b* of the second tabletop portion 12*b*, and the two first tubular portions 38*a* are disposed to either side of the second tubular portion 38*b*. Other embodiments may include other numbers of first and second tubular portions 38*a*-38*b* disposed in other positions along the hinge axis 44.

Preferably, the first tubular portions 38*a* of the central support tube 38 are curved toward the first tabletop portion 12*a*, and the second tubular portion 38*b* is curved toward the second tabletop portion 12*b*. In preferred embodiments, the second tubular portion 38*b* is disposed substantially parallel to the inner edges 42*a* and 42*b* of the first and second tabletop portions 12*a* and 12*b*.

In some embodiments, the first tubular portions 38*a* of the central support tube 38 include apertures 48 through which fasteners pass to attach the central support tube 38 to the first tabletop portion 12*a*.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A collapsible table having a use position and a storage position, the collapsible table comprising:

a tabletop comprising:

a first tabletop portion having a first inner edge and a first bottom surface; and a second tabletop portion having a second inner edge and a second bottom surface, wherein the first and second inner edges are adjacent each other when the table is in the use position, and the first and second inner edges are separated from each other when the table is in the storage position;

a pair of opposing first side rails attached to the first bottom surface of the first tabletop portion;

a pair of opposing second side rails attached to the second bottom surface of the second tabletop portion;

a first leg assembly pivotally connected between the first side rails, the first leg assembly extending downward from the first bottom surface of the first tabletop portion when the table is in the use position, the first leg assembly disposed adjacent the first tabletop portion when the table is in the storage position;

a second leg assembly pivotally connected between the second side rails, the second leg assembly extending downward from the second bottom surface of the second tabletop portion when the table is in the use position, the second leg assembly disposed adjacent the second tabletop portion when the table is in the storage position;

a pair of hinges disposed on a hinge axis, each hinge connecting one of the first side rails to one of the second side rails, such that the first and second tabletop portions are operable to pivot with respect to each other about the hinge axis; and a serpentine-shaped central support tube having tubular portions disposed to either side of the hinge axis for supporting the tabletop in the use position, the tubular portions of the serpentine-shaped central support tube comprising:

one or more first tubular portions disposed to one side of the hinge axis toward the first tabletop portion; and one or more second tubular portions disposed to an opposing side of the hinge axis toward the second tabletop portion, wherein, when the table is in the use position, the one or more first tubular portions engage the first bottom surface to provide support for the first tabletop portion adjacent to the first inner edge, and one or more second tubular portions engage the second bottom surface to provide support for the second tabletop portion adjacent to the second inner edge.

2. The collapsible table of claim 1 wherein the one or more second tubular portions of the central support tube comprise one second tubular portion disposed adjacent a central region of the first inner edge, and the one or more first tubular portions of the central support tube comprise two first tubular portions, wherein one of the two first tubular portions is disposed to either side of the second tubular portion.

3. The collapsible table of claim 2 wherein the two first tubular portions of the central support tube are curved toward the first tabletop portion.

4. The collapsible table of claim 2 wherein the two first tubular portions of the central support tube each include an aperture through which a fastener passes to attach the central support tube to the first bottom surface of the first tabletop portion.

5. The collapsible table of claim 2 wherein the second tubular portion is parallel to the first inner edge of the first tabletop portion.

6. The collapsible table of claim 1 wherein the first and second tabletop portions are formed from blow-molded plastic.

7. The collapsible table of claim 1 wherein the first and second inner edges of the first and second tabletop portions are planar and parallel to the hinge axis.

8. The collapsible table of claim 1 wherein the first leg assembly is pivotally connected to the first side rails and the second leg assembly is pivotally connected to the second side rails.

9. The collapsible table of claim 1 further comprising:

a pair of first articulating brace assemblies connected between the first leg assembly and the first side rails; and a pair of second articulating brace assemblies connected between the second leg assembly and the second side rails.

10. The collapsible table of claim 1, wherein the serpentine-shaped central support tube has a square cross-sectional area perpendicular to the hinge axis.

11. A collapsible table having a use position and a storage position, the collapsible table comprising:

a tabletop comprising:

a first tabletop portion formed from blow-molded plastic and having a first inner edge and a first bottom surface; and a second tabletop portion formed from blow-molded plastic and having a second inner edge and a second bottom surface, wherein the first and second inner edges are planar and adjacent each other when the table is in the use position, and the first and second inner edges are separated from each other when the table is in the storage position;

a pair of opposing first side rails attached to the first bottom surface of the first tabletop portion;

a pair of opposing second side rails attached to the second bottom surface of the second tabletop portion;

a first leg assembly pivotally connected to and between the first side rails, the first leg assembly extending downward from the first tabletop portion when the table is in the use position, the first leg assembly disposed adjacent the first tabletop portion when the table is in the storage position;

a second leg assembly pivotally connected to and between the second side rails, the second leg assembly extending downward from the second tabletop portion when the table is in the use position, the second leg assembly disposed adjacent the second tabletop portion when the table is in the storage position;

a pair of first articulating brace assemblies connected between the first leg assembly and the first side rails;

a pair of second articulating brace assemblies connected between the second leg assembly and the second side rails;

a pair of hinges disposed on a hinge axis that is parallel to the first and second inner edges of the first and second tabletop portions, each hinge connecting one of the first side rails to one of the second side rails, such that the first and second tabletop portions are operable to pivot with respect to each other about the hinge axis; and a serpentine-shaped central support tube disposed along the hinge axis, the central support tube comprising:

two first tubular portions disposed to one side of the hinge axis toward the first tabletop portion; and one second tubular portion disposed to an opposing side of the hinge axis toward the second tabletop portion, the one second tubular portion disposed adjacent a central region of the first inner edge between the two first tubular portions, wherein, when the table is in the use position, the two first tubular portions engage the first bottom surface of the first tabletop portion to provide support for the first tabletop portion adjacent to the first inner edge, and the one second tubular portion engages the second bottom surface of the second tabletop portion to provide support for the second tabletop portion adjacent to the second inner edge.

12. The collapsible table of claim 11 wherein the two first tubular portions of the central support tube are curved toward the first tabletop portion.

13. The collapsible table of claim 11 wherein the two first tubular portions of the central support tube each include an aperture through which a fastener passes to attach the central support tube to the first bottom surface of the first tabletop portion.

14. The collapsible table of claim 11 wherein the second tubular portion is parallel to the first inner edge of the first tabletop portion.

15. The collapsible table of claim 11, wherein the serpentine-shaped central support tube has a square cross-sectional area perpendicular to the hinge axis.

* * * * *